US010633206B2

(12) United States Patent
Tsai

(10) Patent No.: US 10,633,206 B2
(45) Date of Patent: Apr. 28, 2020

(54) PAPER FEEDING DEVICE AND PAPER SKEW JUDGING MODULE APPLIED THEREIN

(71) Applicant: Foxlink Image Technology Co., Ltd., New Taipei (TW)

(72) Inventor: Wei Xiang Tsai, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 145 days.

(21) Appl. No.: 15/924,303

(22) Filed: Mar. 19, 2018

(65) Prior Publication Data

US 2019/0284000 A1 Sep. 19, 2019

(51) Int. Cl.

| | |
|---|---|
| ***B65H 9/18*** | (2006.01) |
| ***B65H 5/06*** | (2006.01) |
| ***B65H 9/20*** | (2006.01) |

(52) U.S. Cl.

CPC ..... *B65H 9/18* (2013.01); *B65H 5/06* (2013.01); *B65H 9/20* (2013.01)

(58) Field of Classification Search

CPC ... B65H 9/18; B65H 9/20; B65H 9/00; B65H 9/002; B65H 2553/612; B65H 2511/242; B65H 2553/412; B65H 7/14

See application file for complete search history.

(56) References Cited

U.S. PATENT DOCUMENTS

2010/0052237 A1* 3/2010 Herczeg ..... B65H 7/00 271/3.16
2014/0239579 A1* 8/2014 Yanagida ..... B65H 7/14 271/227

* cited by examiner

*Primary Examiner* — Thomas A Morrison
(74) *Attorney, Agent, or Firm* — Lin & Associates Intellectual Property, Inc.

(57) ABSTRACT

A paper feeding device includes a lower cover, an upper cover pivotally connected to the lower cover, at least one motor mounted to the lower cover, a feeding roller assembly and a paper skew judging module. The feeding roller assembly is pivotally connected to the lower cover and connected with the at least one motor. The paper skew judging module disposed to the lower cover, has an infrared light emitter, an infrared light receiver, a cantilever arm rotatably assembled to the lower cover, a sensing roller pivotally connected with the cantilever arm, and a lens. The infrared light emitter is mounted to the lower cover. The infrared light receiver is mounted to the lower cover and is disposed opposite to the infrared light emitter. The lens is fastened to the cantilever arm, and disposed between the infrared light emitter and the infrared light receiver. The lens has different photopermeabilities.

12 Claims, 14 Drawing Sheets

PAPER FEEDING DEVICE AND PAPER SKEW JUDGING MODULE APPLIED THEREIN

BACKGROUND OF THE INVENTION

1. Field of the Invention

The present invention generally relates to a paper feeding device, and more particularly to a paper feeding device having a paper skew judging function, and a paper skew judging module applied therein.

2. The Related Art

Referring to FIG. 13 and FIG. 14, a conventional paper feeding device 100' for feeding paper 200' is generally applied in a scanner or a printer etc. The conventional paper feeding device 100' includes a load tray 10', two feeding rollers 20' and two speed sensors 30'. The load tray 10' is used for loading a plurality of the paper 200'. The plurality of the paper 200' is stacked in the load tray 10'. A feeding direction L of the paper 200' for printing or being scanned is defined as a lengthwise direction of the paper 200'. A direction horizontally across the feeding direction L is defined as a widthwise direction W of the paper 200'. The two feeding rollers 20' are disposed above the load tray 10' and are arranged transversely along the widthwise direction W of the paper 200'. The two speed sensors 30' are disposed above the load tray 10' and are arranged transversely along the widthwise direction W of the paper 200'. The two speed sensors 30' are located between the two feeding rollers 20' and behind a center axis C1' of the two feeding rollers 20'.

When the paper 200' is fed into the conventional paper feeding device 100', the two feeding rollers 20' and the two speed sensors 30' all abut against a top surface of the paper 200' for printing or being scanned, namely the two feeding rollers 20' and the two speed sensors 30' are located on an uppermost piece of the paper 200' for printing or being scanned in the load tray 10'. The two feeding rollers 20' rotate anticlockwise to drive the paper 200' to be fed into the conventional paper feeding device 100'. The two speed sensors 30' will simultaneously sense feeding speeds of two sides of the fed paper 200', respectively.

When the paper 200' is fed into the conventional paper feeding device 100', confirm whether the paper 200' is skewed and what a skew angle value of the paper 200' is according to a speed difference value between the feeding speeds of the two sides of the fed paper 200'. When the speed difference value between the feeding speeds of the two sides of the fed paper 200' exceeds a preset speed difference value, namely the skew angle value of the fed paper 200' is greater than a preset angle value, the paper 200' is confirmed to be skewed and the conventional paper feeding device 100' stops feeding the paper 200' for preventing the paper 200' from being damaged.

However, because the conventional paper feeding device 100' has a paper skew judging function need be equipped with the two speed sensors 30', a manufacturing cost of the conventional paper feeding device 100' is higher.

Thus, in order to solve the above-mentioned problem, an innovative paper feeding device and a paper skew judging module applied in the innovative paper feeding device need be designed, the innovative paper feeding device has a paper skew judging function and a manufacturing cost of the innovative paper feeding device is lower.

SUMMARY OF THE INVENTION

An object of the present invention is to provide a paper feeding device for feeding paper. The paper feeding device includes a lower cover, an upper cover pivotally connected to the lower cover, at least one motor mounted to the lower cover, a feeding roller assembly and a paper skew judging module. A paper feeding channel is formed between the upper cover and the lower cover. The feeding roller assembly is pivotally connected to the lower cover and projects into the paper feeding channel. The feeding roller assembly is connected with the at least one motor. The at least one motor drives the feeding roller assembly to feed the paper into the paper feeding device along a paper feeding direction. The paper skew judging module is disposed to the lower cover for judging whether the fed paper is skewed or not. The paper skew judging module has an infrared light emitter, an infrared light receiver, a cantilever arm, a sensing roller and a lens. The infrared light emitter is mounted to the lower cover. The infrared light receiver is mounted to the lower cover and is disposed opposite to the infrared light emitter for receiving infrared light emitted from the infrared light emitter. The cantilever arm is rotatably assembled to the lower cover. The sensing roller is pivotally connected with a top end of the cantilever arm. A center axis of the sensing roller extends along a direction perpendicular to the paper feeding direction. A top of the sensing roller projects into the paper feeding channel. The lens is fastened to the cantilever arm, and disposed between the infrared light emitter and the infrared light receiver. Different areas of the lens have different photopermeabilities. The infrared light receiver is used for receiving infrared light emitted from the infrared light emitter and penetrating through the lens.

Another object of the present invention is to provide a paper skew judging module applied in a paper feeding device. The paper skew judging module includes an infrared light emitter, an infrared light receiver disposed opposite to the infrared light emitter, a cantilever arm swinging laterally, a sensing roller pivotally connected with a top end of the cantilever arm, and a lens. A center axis of the sensing roller extends along a direction perpendicular to a paper feeding direction. The lens is fastened to the cantilever arm, and disposed between the infrared light emitter and the infrared light receiver. Different areas of the lens have different photopermeabilities. The infrared light receiver is used for receiving infrared light emitted from the infrared light emitter and penetrating through the lens.

As described above, an inside of the paper feeding device is equipped with the paper skew judging module, the paper feeding device uses the paper skew judging module to detect whether the fed paper is skewed or not, so that a speed sensor is no need of being disposed to the paper feeding device, a cost of the paper skew judging module is lower than a cost of the speed sensor. As a result, a manufacturing cost of the paper feeding device is lowered.

BRIEF DESCRIPTION OF THE DRAWING

The present invention will be apparent to those skilled in the art by reading the following description, with reference to the attached drawing, in which.

DETAILED DESCRIPTION OF THE PREFERRED EMBODIMENT

Figure 1:
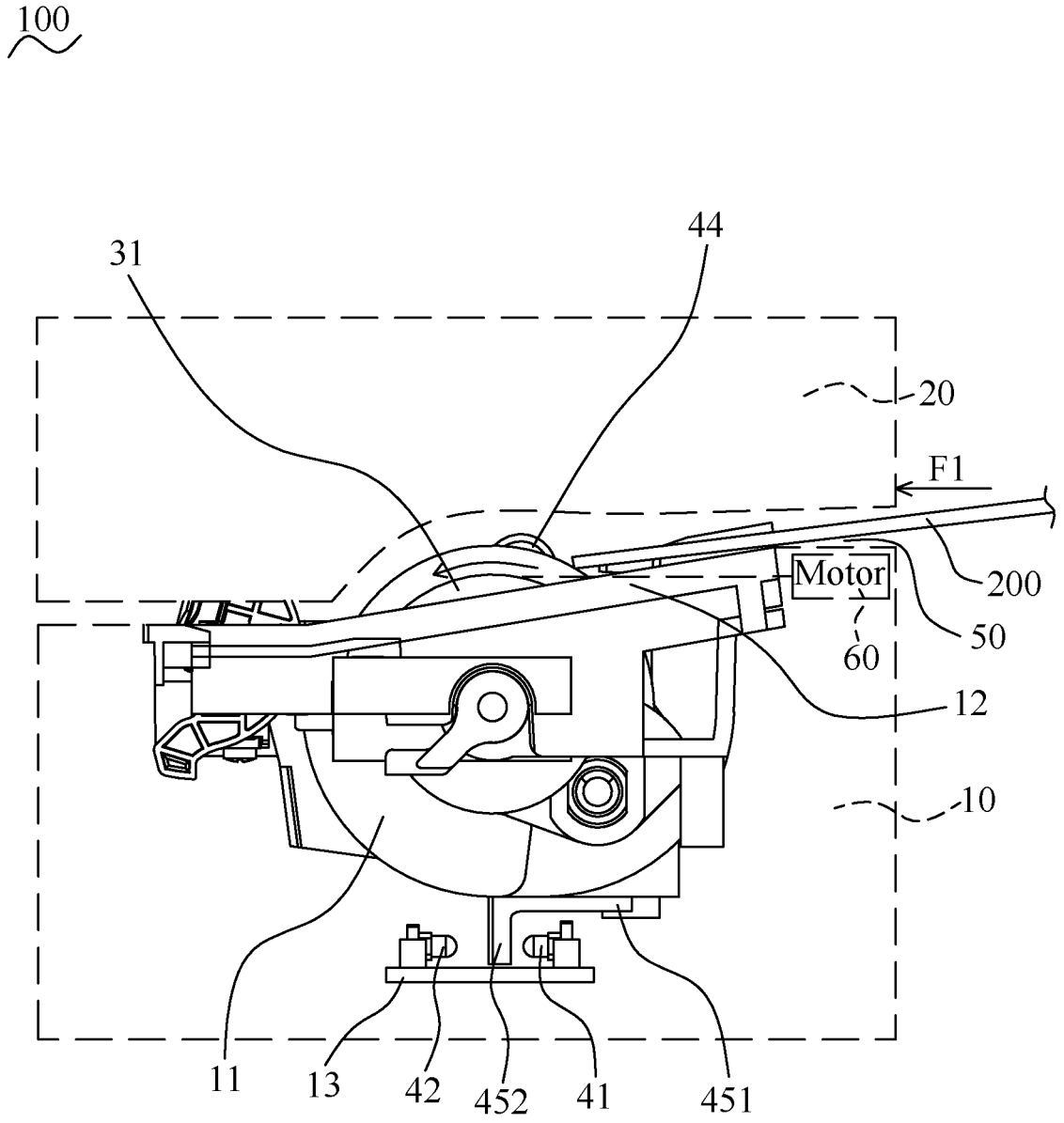
FIG. 1 is a diagrammatic drawing of a paper feeding device in accordance with the present invention.
Figure 2:
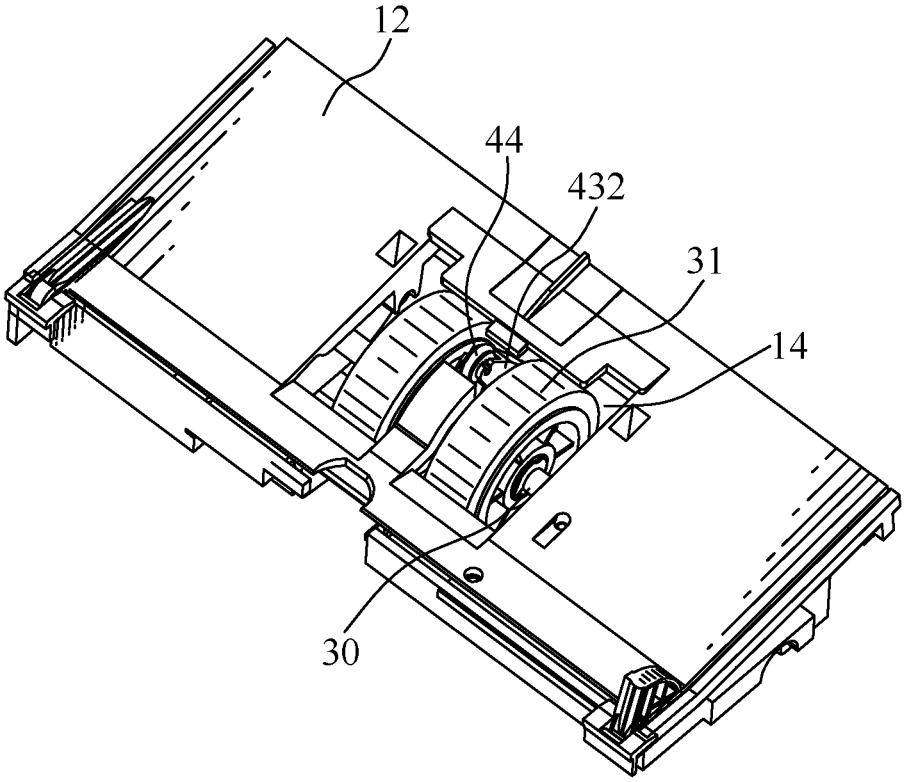
FIG. 2 is a perspective view of the paper feeding device of FIG. 1, wherein an upper cover and a lower cover are omitted.
Figure 5:
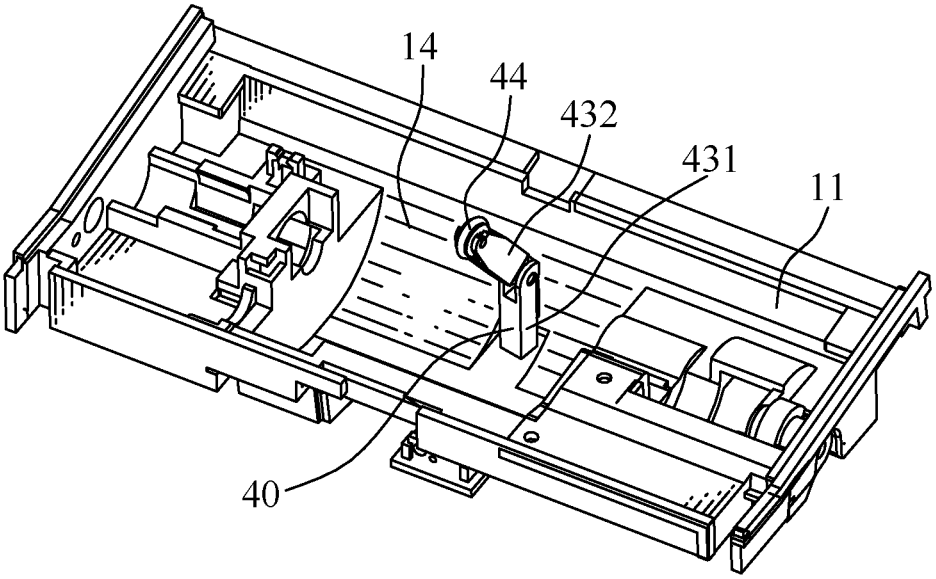
FIG. 5 is a partially perspective view of the paper feeding device of FIG. 1, wherein a paper skew judging module is assembled to the base holder of the paper feeding device.

With reference to FIG. 1, FIG. 2 and FIG. 5, a paper feeding device 100 in accordance with the present invention is shown. The paper feeding device 100 having a paper skew judging function is used for feeding paper 200. The paper feeding device 100 includes a lower cover 10, an upper cover 20, at least one motor 60, a feeding roller assembly 30 and a paper skew judging module 40. The upper cover 20 is pivotally connected to the lower cover 10. A paper feeding channel 50 is formed between the upper cover 20 and the lower cover 10.

Figure 3:
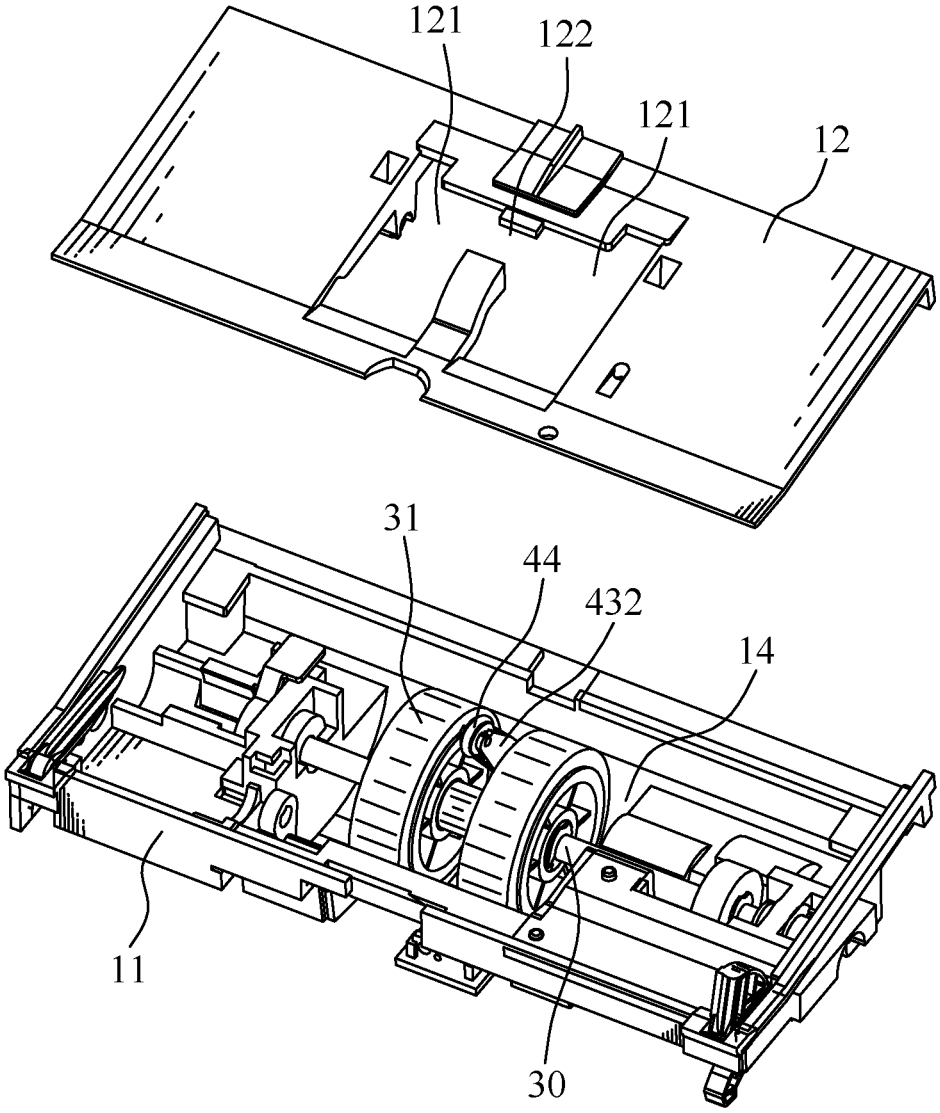
FIG. 3 is an exploded view of the paper feeding device of FIG. 2.
Figure 4:
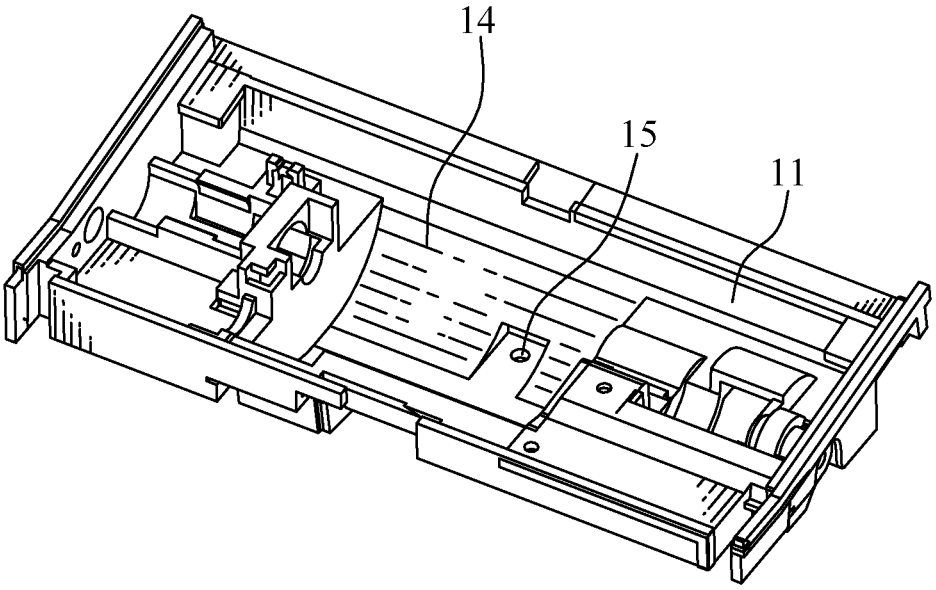
FIG. 4 is a perspective view of a base holder of the paper feeding device in accordance with the present invention.

Referring to FIG. 1, FIG. 3 and FIG. 4, the lower cover 10 includes a base holder 11, a sealing board 12 and a base board 13. A middle of a top surface of the base holder 11 is concaved downward to form a receiving space 14. A bottom of the base holder 11 opens a pivoting hole 15 communicated with the receiving space 14. The sealing board 12 is covered to the top surface of the base holder 11. The paper feeding channel 50 is formed between a top surface of the sealing board 12 and a bottom surface of the upper cover 20. The sealing board 12 forms two first openings 121 arranged transversely and spaced from each other. The two first openings 121 are located above the receiving space 14, and the two first openings 121 are communicated between the receiving space 14 and the paper feeding channel 50. A middle of the sealing board 12 forms a second opening 122 located between the two first openings 121.

Referring to FIG. 1, FIG. 2, FIG. 3 and FIG. 8, the at least one motor 60 is mounted to the lower cover 10. The feeding roller assembly 30 is pivotally connected to the lower cover 10 and projects into the paper feeding channel 50. The feeding roller assembly 30 is connected with the at least one motor 60. The at least one motor 60 drives the feeding roller assembly 30 to feed the paper 200 into the paper feeding device 100 along a paper feeding direction F1. Specifically, the feeding roller assembly 30 includes two feeding rollers 31 arranged transversely and spaced from each other. The two feeding rollers 31 are pivotally connected to the base holder 11 and are received in the receiving space 14. The two feeding rollers 31 project beyond the top surface of the sealing board 12 through the two first openings 121. A center axis D1 of the two feeding rollers 31 extends along a direction perpendicular to the paper feeding direction F1. The base board 13 is disposed under the base holder 11.

Figure 6:
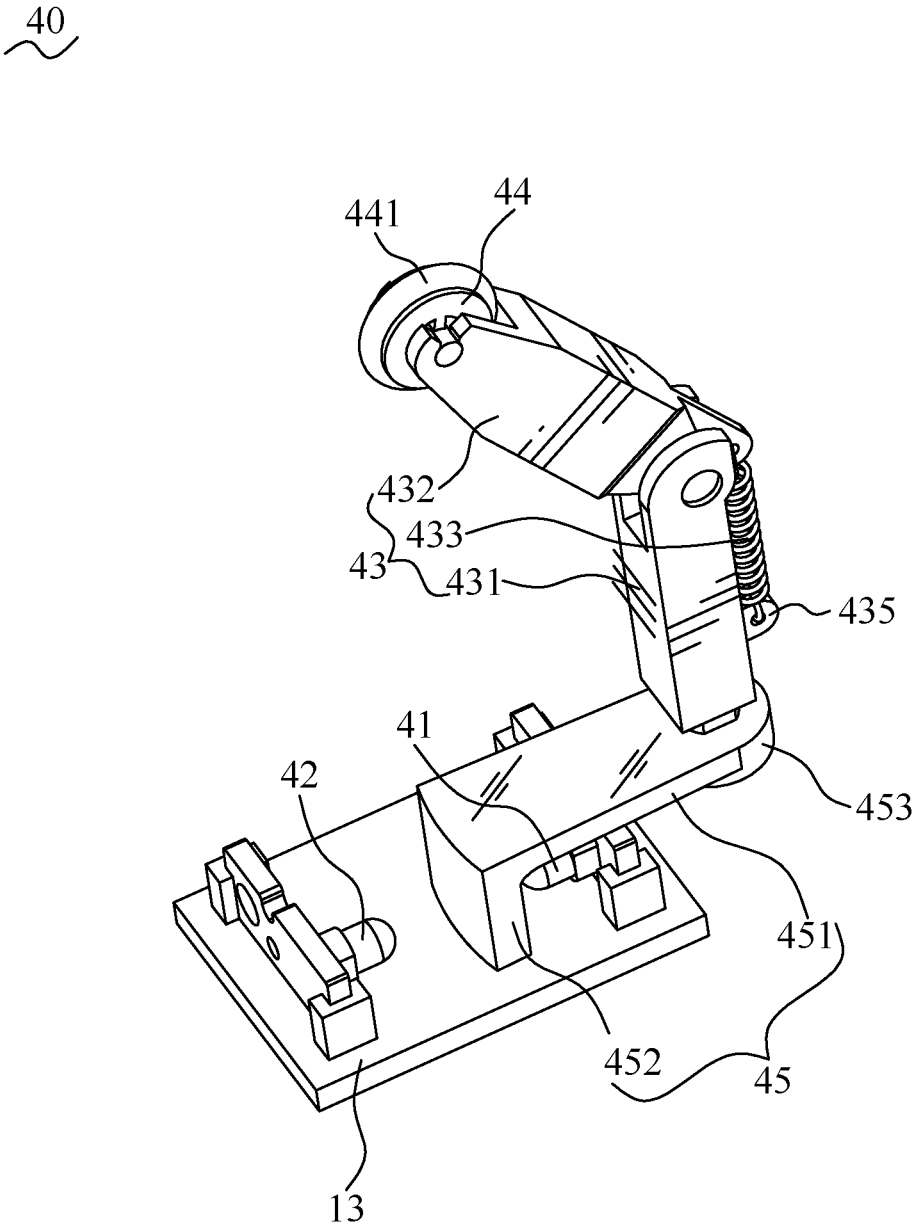
FIG. 6 is a perspective view of the paper skew judging module of the paper feeding device of FIG. 5.
Figure 7:
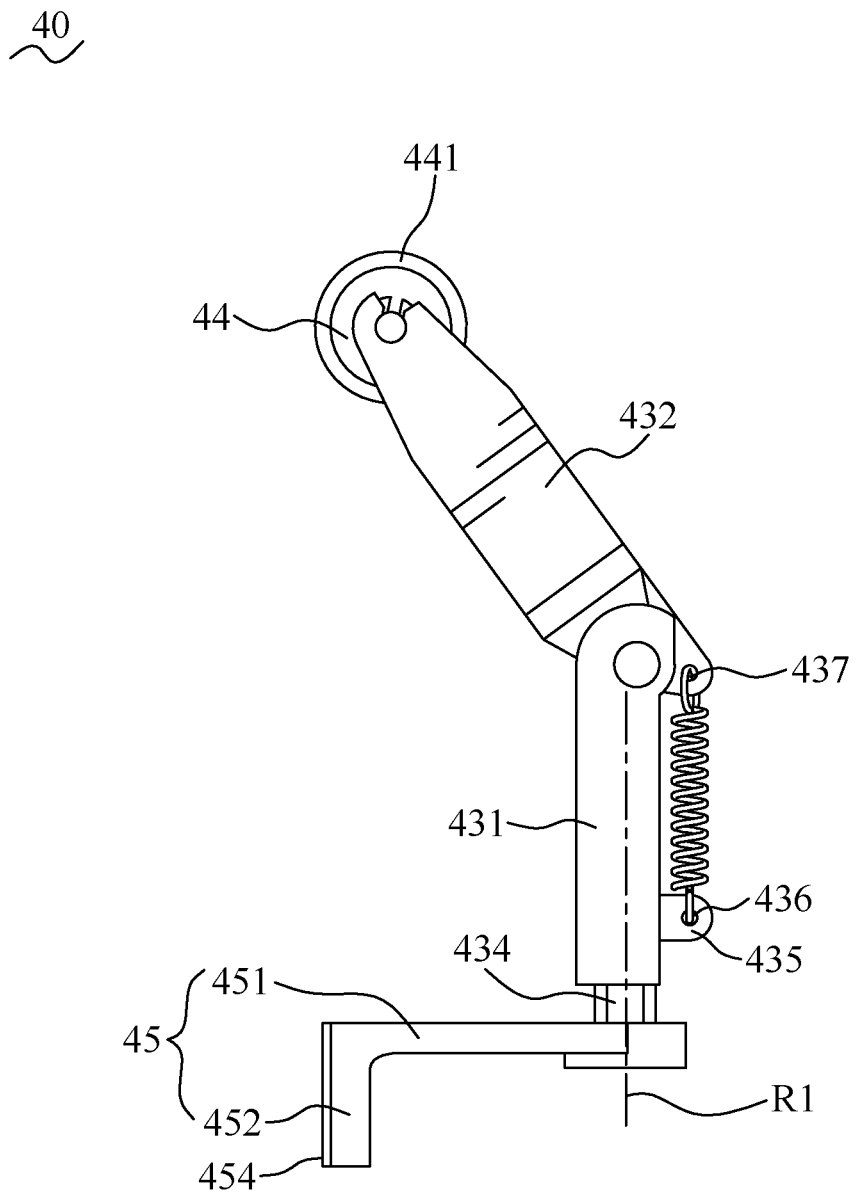
FIG. 7 is a right side view of the paper skew judging module of the paper feeding device of FIG. 5.

Referring to FIG. 5, FIG. 6 and FIG. 7, the paper skew judging module 40 is applied in the paper feeding device 100. The paper skew judging module 40 is disposed to the lower cover 10 for judging whether the fed paper 200 is skewed or not. The paper skew judging module 40 has an infrared light emitter 41, an infrared light receiver 42, a cantilever arm 43, a sensing roller 44 and a lens 45. The infrared light emitter 41 is mounted to the base holder 11 of the lower cover 10. The infrared light receiver 42 is mounted to the base holder 11 of the lower cover 10 and is disposed opposite to the infrared light emitter 41 for receiving infrared light emitted from the infrared light emitter 41. Specifically, the infrared light emitter 41 and the infrared light receiver 42 are both fastened on the base board 13. The paper skew judging module 40 is capable of judging whether the fed paper 200 is skewed or not. The paper feeding device 100 uses the paper skew judging module 40 to judge whether the fed paper 200 is skewed or not.

Figure 8:
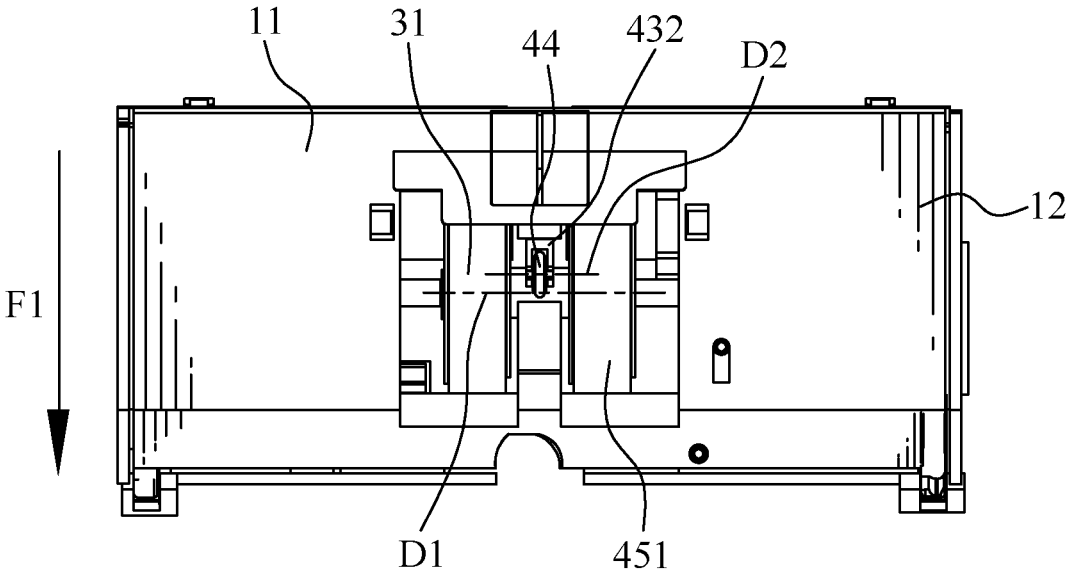
FIG. 8 is a top view of the paper feeding device in accordance with the present invention, wherein the upper cover and the lower cover are omitted.
Figure 9:
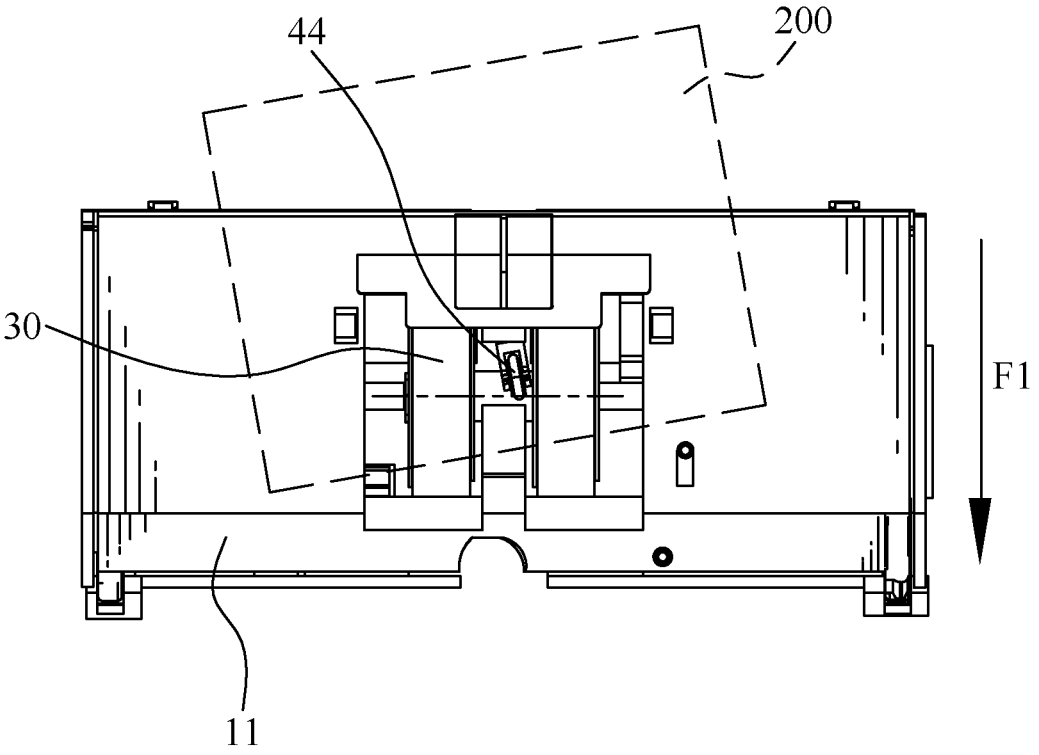
FIG. 9 is a diagrammatic drawing of the paper feeding device in accordance with the present invention, wherein a paper is askew fed into the paper feeding device.

Referring to FIG. 1, FIG. 5 and FIG. 8, the cantilever arm 43 is rotatably assembled to the lower cover 10. The cantilever arm 43 swings laterally. An outside of the sensing roller 44 is sleeved with a rubber ring 441. The sensing roller 44 is pivotally connected with a top end of the cantilever arm 43. A center axis D2 of the sensing roller 44 extends along the direction perpendicular to the paper feeding direction F1. A top of the sensing roller 44 projects beyond the top surface of the sealing board 12 through the second opening 122 and projects into the paper feeding channel 50. The top of the sensing roller 44 projects beyond the two feeding rollers 31. The center axis D2 of the sensing roller 44 and the center axis D1 of the two feeding rollers 31 are arranged in sequence. The center axis D2 of the sensing roller 44 and the center axis D1 of the two feeding rollers 31 are spaced from each other. The center axis D2 of the sensing roller 44 is located between the center axis D1 of the two feeding rollers 31 and an initiating end of the paper feeding channel 50.

Referring to FIG. 3 to FIG. 7, specifically, the cantilever arm 43 includes a first supporting arm 431, a second supporting arm 432 and a spring 433. The first supporting arm 431 is pivotally connected to the base holder 11 along the direction perpendicular to the paper feeding direction F1. The first supporting arm 431 is received in the receiving space 14. A bottom surface of the first supporting arm 431 protrudes downward to form a fastening pillar 434. The bottom surface of the first supporting arm 431 abuts against a bottom wall of the receiving space 14. The fastening pillar 434 of the first supporting arm 431 is received in the pivoting hole 15 and projects beyond a bottom surface of the base holder 11.

The second supporting arm 432 is pivotally connected to the top of the first supporting arm 431 and is capable of rotating upward and downward with respect to the paper feeding direction F1. One end of the spring 433 is fastened to a rear surface of the first supporting arm 431, and the other end of the spring 433 is fastened to a bottom end of the second supporting arm 432, so that the second supporting arm 432 keeps a status of inclining upward and having an elasticity with respect to the first supporting arm 431. The sensing roller 44 is pivotally connected with a tail end of the second supporting arm 432. Specifically, the rear surface of the first supporting arm 431 protrudes rearward to form a protruding ear 435. A middle of the protruding ear 435 opens a first fastening hole 436. The bottom end of the second supporting arm 432 opens a second fastening hole 437. Two opposite ends of the spring 433 are fastened in the first fastening hole 436 and the second fastening hole 437, respectively.

The lens 45 is disposed on the base board 13 and is disposed between the infrared light emitter 41 and the infrared light receiver 42. The lens 45 is fastened to a bottom of the cantilever arm 43. Specifically, the lens 45 has a connecting portion 451 extending in the paper feeding direction F1 and located above the base board 13, and a main portion 452 fastened to one end of the connecting portion 451. The main portion 452 extends downward from the one end of the connecting portion 451 and is perpendicular to the connecting portion 451. The main portion 452 is disposed on the base board 13 and disposed between the infrared light emitter 41 and the infrared light receiver 42. The other end of the connecting portion 451 is defined as a fastening end 453. The fastening end 453 of the connecting portion 451 is fastened to a bottom of the fastening pillar 434.

Figure 10:
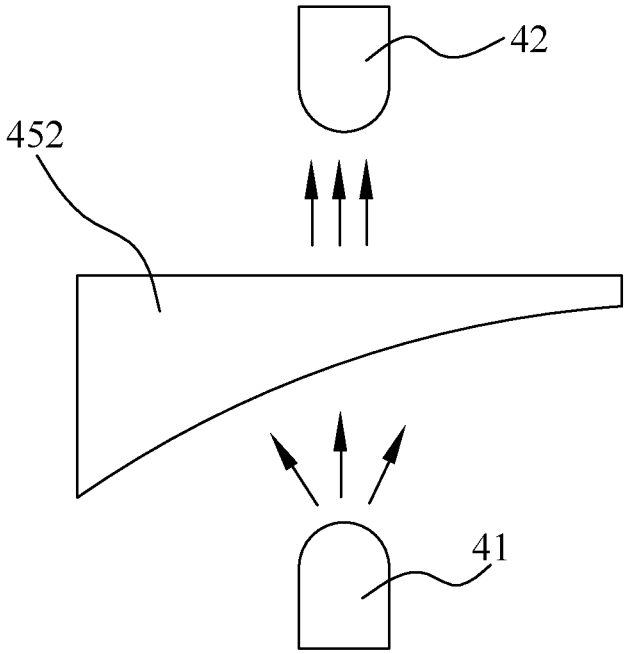
FIG. 10 is a diagrammatic drawing of the paper skew judging module of the paper feeding device in accordance with a preferred embodiment of the present invention, wherein an infrared light receiver receives infrared light passing through a main body of a lens.

Referring to FIG. 6, FIG. 7 and FIG. 10, different areas of the lens 45 have different photopermeabilities. The infrared light receiver 42 is used for receiving the infrared light emitted from the infrared light emitter 41 and penetrating through the main portion 452 of the lens 45.

The main portion 452 of the lens 45 of the paper skew judging module 40 of the paper feeding device 100 in accordance with a preferred embodiment of the present invention is shown. A surface of the main portion 452 of the lens 45 facing to the infrared light emitter 41 is an arc-shaped surface arched inward away from the infrared light emitter 41. Thicknesses of two opposite sides of the main portion 452 of the lens 45 are different. The two opposite sides of the main portion 452 of the lens 45 with the different thicknesses are a left side and a right side. The left side and the right side of the main portion 452 of the lens 45 are arranged opposite to each other along the direction perpendicular to the paper feeding direction F1, and the left side and the right side of the main portion 452 of the lens 45 are perpendicular to the base board 13. A gradual transition is formed from the thickness of one side of the main portion 452 to the thickness of the other side of the main portion 452. The gradual transition is formed from the thickness of the left side of the main portion 452 to the thickness of the right side of the main portion 452. An inside of the main portion 452 is added with a light blocking agent, or an outer surface 454 of the main portion 452 is coated with the light blocking agent. The light blocking agent is titanium dioxide. Intensities of the infrared light received by the infrared light receiver 42 and emitted from the infrared light emitter 41, and penetrating through the different areas of the main portion 452 are changed more obviously by virtue of the main portion 452 being added or coated with the light blocking agent.

Referring to FIG. 7 to FIG. 12, the main portion 452 of the lens 45 of the paper skew judging module 40 of the paper feeding device 100 in accordance with another preferred embodiment of the present invention is shown. Each of different areas of the outer surface 454 of the main portion 452 has one of different textures, indentations, shapes and other designs to realize that the different areas of the lens 45 have the different photopermeabilities.

Figure 11:
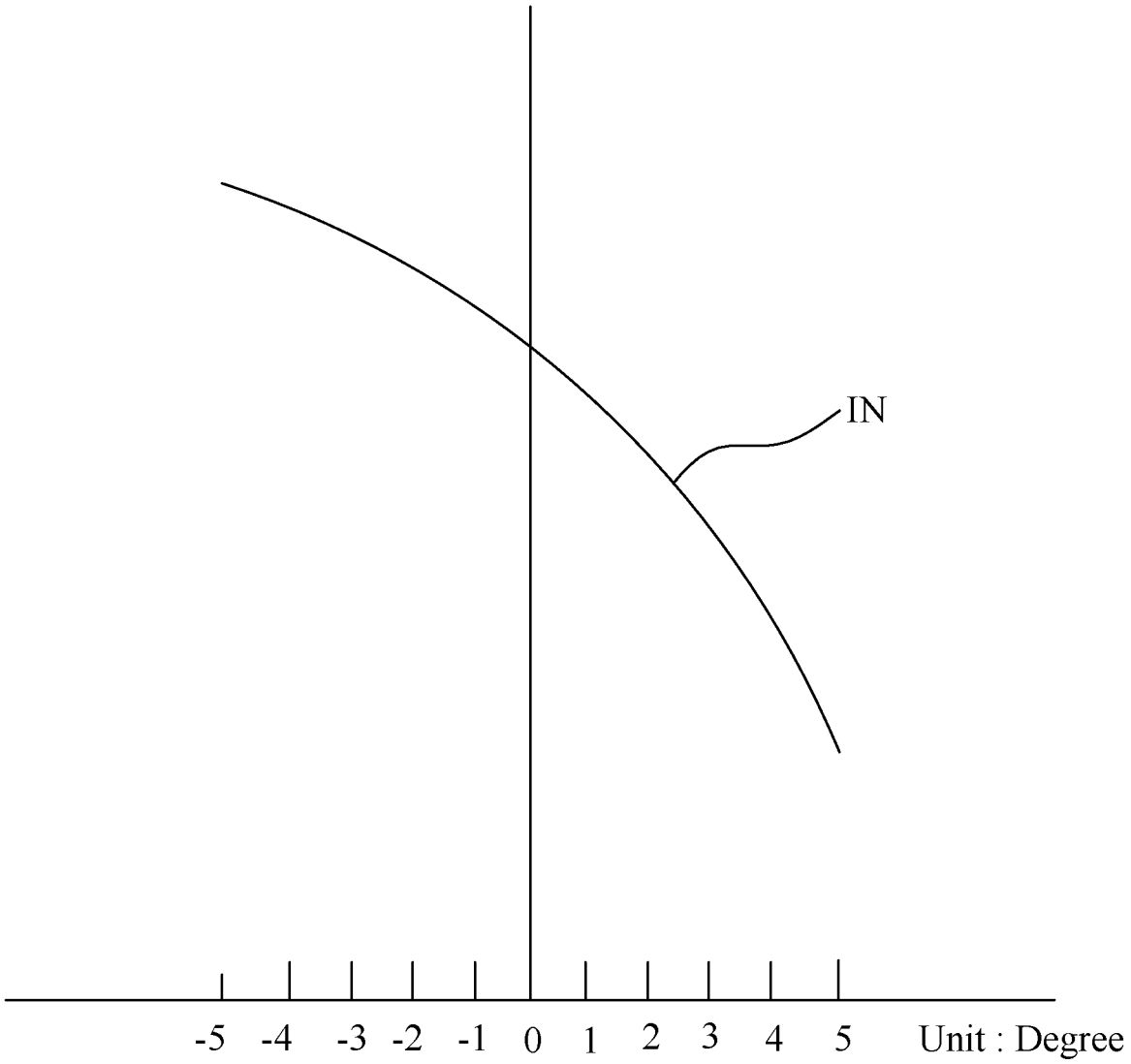
FIG. 11 is a variation curve of the infrared light with different intensities, wherein the infrared light is emitted from an infrared light emitter, and received by the infrared light receiver of the paper skew judging module and penetrates through different areas of the main body, and judge an skew angle of the paper fed into the paper feeding device according to the received infrared light with the different intensities.
Figure 12:
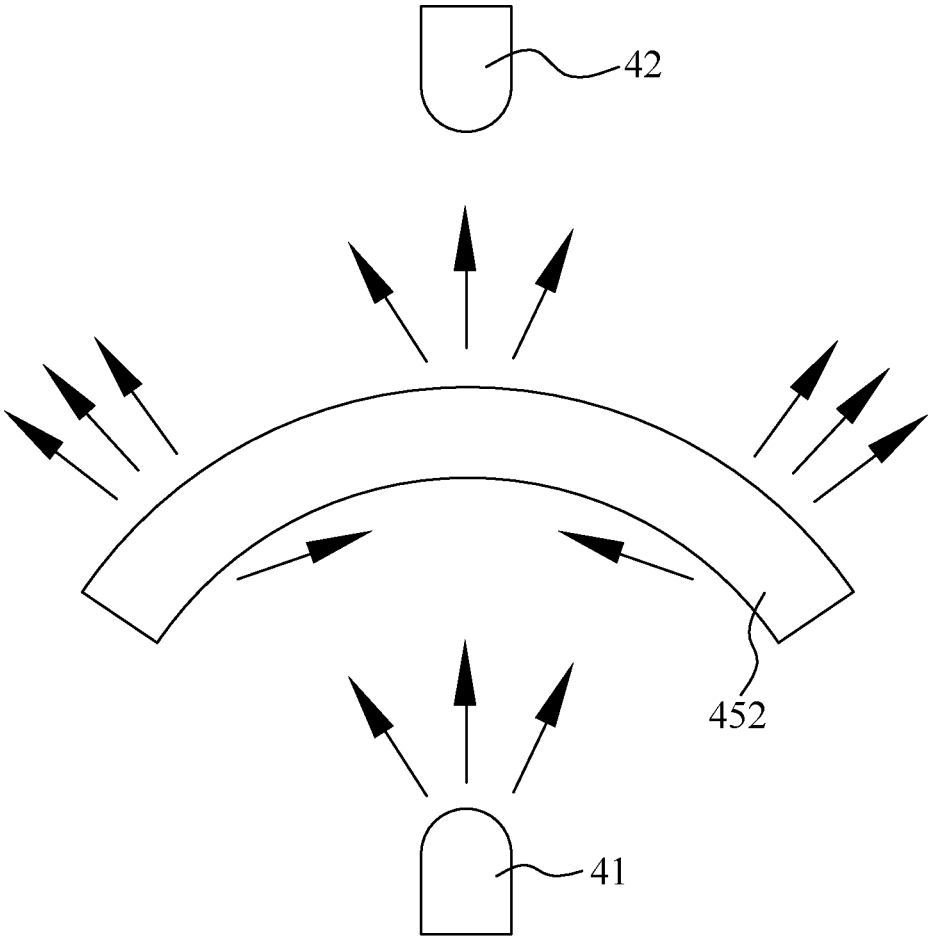
FIG. 12 is an optical path diagram of the paper skew judging module of the paper feeding device in accordance with another preferred embodiment of the present invention, wherein different areas of an outer surface of the main body of the lens have different textures, indentations or shapes.
Figure 13:
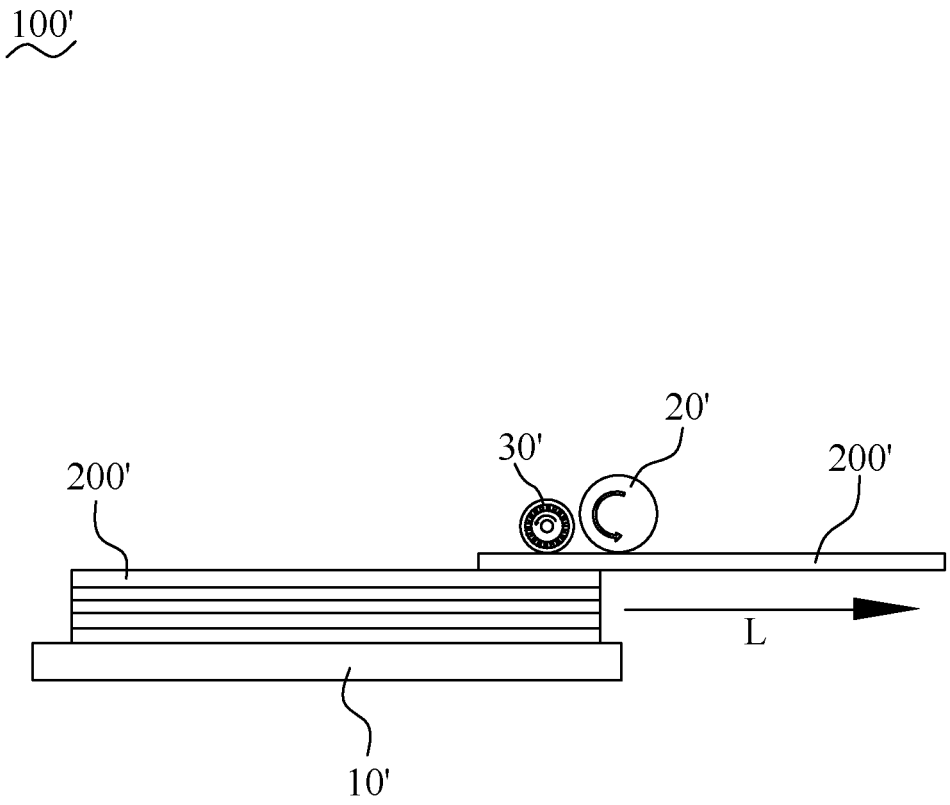
FIG. 13 (Prior Art)
FIG. 13 is a diagrammatic drawing of a conventional paper feeding device in prior art.
Figure 14:
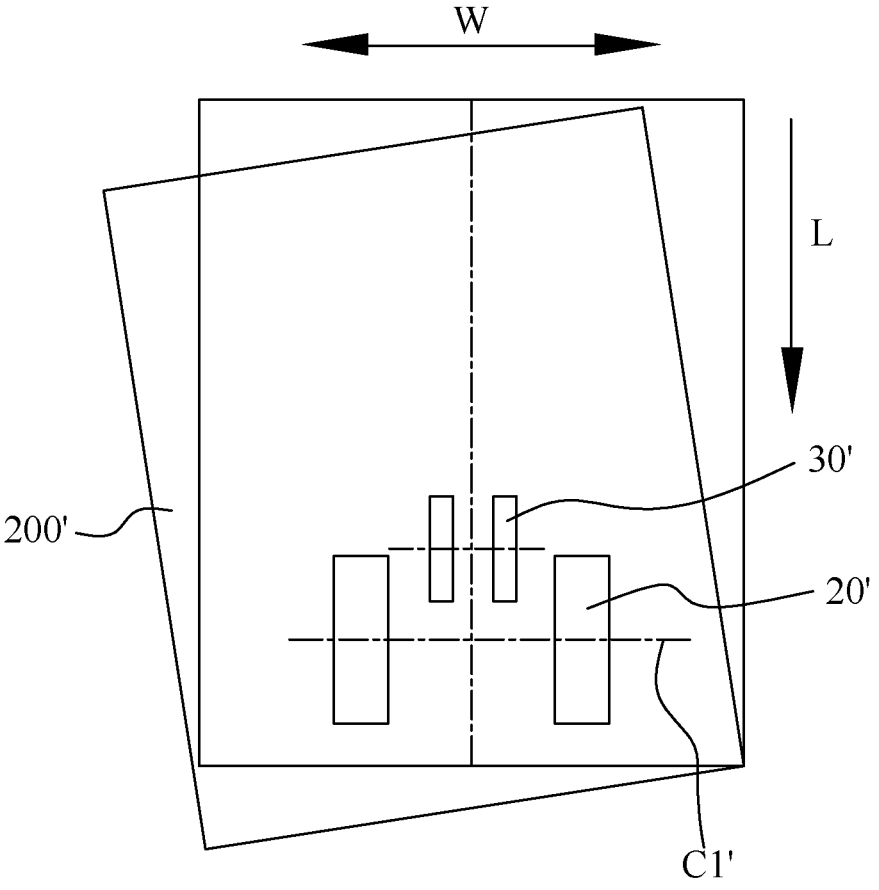
FIG. 14 (Prior Art)
FIG. 14 is a diagrammatic drawing of the conventional paper feeding device, wherein a paper is fed into the conventional paper feeding device.

Referring to FIG. 1 to FIG. 11, a curve IN shown in FIG. 11 is shown as a variation curve of the infrared light with the different intensities, and the infrared light is received by the infrared light receiver 42 and emitted from the infrared light emitter 41, and penetrates through the different areas of the main portion 452. Abscissa values shown in FIG. 11 denote skew angles of the fed paper 200 converted by the corresponding infrared light with the different intensities when the paper 200 is fed in. Working principles of the paper feeding device 100 and the paper skew judging module 40 are described as follows. When the paper 200 is fed in, the paper 200 will exert a downward force on the sensing roller 44 to make the second supporting arm 432 rotate downward with respect to the paper feeding direction F1. The paper skew judging module 40 judges an skew angle of the paper 200 fed into the paper feeding device 100 according to the received infrared light with the different intensities. When the fed paper 200 is skewed towards a leftward or rightward direction perpendicular to the paper feeding direction F1, a component force of the fed paper 200 being skewed towards the leftward or rightward direction is exerted on the sensing roller 44 to make the sensing roller 44 swing towards the leftward or rightward direction so as to bring along the first supporting arm 431 to pivot a center axis R1 of the first supporting arm 431 to rotate towards the leftward or rightward direction and further bring along the main portion 452 of the lens 45 to swing towards the leftward or rightward direction, at the moment, the infrared light receiver 42 receives the infrared light emitted from the infrared light emitter 41 and penetrates through the different areas of the main portion 452 of the lens 45, so that the infrared light with the different intensities will be received, different currents or voltages can be correspondingly converted by virtue of receiving the infrared light with the different intensities.

Before the paper feeding device 100 is left from the factory, different skewed angles of the sensing roller 44 and the paper 200 are preset by virtue of receiving the currents or the voltages with the different intensities, in use, the skew angles of the sensing roller 44 and the fed paper 200 at the time of the paper 200 being fed in are capable of being correspondingly ensured by virtue of the corresponding currents and the voltages being converted by the infrared light with the different intensities and received by the infrared light receiver 42, and then judge whether the paper 200 need stop being fed in or not according to the skew angle of the fed paper 200 at the time of the paper 200 being fed in.

As described above, an inside of the paper feeding device 100 is equipped with the paper skew judging module 40, the paper feeding device 100 uses the paper skew judging module 40 to detect whether the fed paper 200 is skewed or not, so that a speed sensor is no need of being disposed to the paper feeding device 100, a cost of the paper skew judging module 40 is lower than a cost of the speed sensor. As a result, a manufacturing cost of the paper feeding device 100 is lowered.

What is claimed is:

1. A paper feeding device for feeding paper, comprising:

a lower cover;

an upper cover pivotally connected to the lower cover, a paper feeding channel being formed between the upper cover and the lower cover;

at least one motor mounted to the lower cover;

a feeding roller assembly pivotally connected to the lower cover and projecting into the paper feeding channel, the feeding roller assembly being connected with the at least one motor, the at least one motor driving the feeding roller assembly to feed the paper into the paper feeding device along a paper feeding direction; and a paper skew judging module disposed to the lower cover for judging whether the fed paper is skewed or not, the paper skew judging module having an infrared light emitter, an infrared light receiver, a cantilever arm, a sensing roller and a lens, the infrared light emitter being mounted to the lower cover, the infrared light receiver being mounted to the lower cover and being disposed opposite to the infrared light emitter for receiving infrared light emitted from the infrared light emitter, the cantilever arm being rotatably assembled to the lower cover, the sensing roller being pivotally connected with a top end of the cantilever arm, a center axis of the sensing roller extending along a direction perpendicular to the paper feeding direction, a top of the sensing roller projecting into the paper feeding channel, the lens being fastened to the cantilever arm, and disposed between the infrared light emitter and the infrared light receiver, different areas of the lens having different photopermeabilities, the infrared light receiver being used for receiving infrared light emitted from the infrared light emitter and penetrating through the lens.

2. The paper feeding device as claimed in claim 1, wherein the lower cover includes a base holder, a sealing board and a base board, a middle of a top surface of the base holder is concaved downward to form a receiving space, the sealing board is covered to the top surface of the base holder, the paper feeding channel is formed between a top surface of the sealing board and a bottom surface of the upper cover, the sealing board forms two first openings arranged transversely and spaced from each other, the two first openings are located above the receiving space and communicated between the receiving space and the paper feeding channel, the feeding roller assembly includes two feeding rollers arranged transversely and spaced from each other, the two feeding rollers are pivotally connected to the base holder and are received in the receiving space, the two feeding rollers project beyond the top surface of the sealing board through the two first openings, a center axis of the two feeding rollers extends along the direction perpendicular to the paper feeding direction, the base board is disposed under the base holder, the infrared light emitter and the infrared light receiver are both fastened on the base board.

3. The paper feeding device as claimed in claim 2, wherein the sealing board forms a second opening located between the two first openings, the sensing roller projects beyond the top surface of the sealing board through the second opening and projects into the paper feeding channel, a top of the sensing roller projects beyond the two feeding rollers, a center axis of the sensing roller and the center axis of the two feeding rollers are arranged in sequence, the center axis of the sensing roller is located between the center axis of the two feeding rollers and an initiating end of the paper feeding channel.

4. The paper feeding device as claimed in claim 2, wherein the cantilever arm includes a first supporting arm, a second supporting arm and a spring, the first supporting arm is pivotally connected to the base holder along the direction perpendicular to the paper feeding direction, the first supporting arm is received in the receiving space, the second supporting arm is pivotally connected to a top of the first supporting arm and is capable of rotating upward and downward with respect to the paper feeding direction, one end of the spring is fastened to a rear surface of the first supporting arm, and the other end of the spring is fastened to a bottom end of the second supporting arm, so that the second supporting arm keeps a status of inclining upward and having an elasticity with respect to the first supporting arm, the sensing roller is pivotally connected with a tail end of the second supporting arm.

5. The paper feeding device as claimed in claim 4, wherein a bottom of the base holder opens a pivoting hole communicated with the receiving space, a bottom surface of the first supporting arm protrudes downward to form a fastening pillar, the bottom surface of the first supporting arm abuts against a bottom wall of the receiving space, the fastening pillar is received in the pivoting hole and projects beyond a bottom surface of the base holder, the lens has a connecting portion extending in the paper feeding direction and located above the base board, and a main portion fastened to one end of the connecting portion, the main portion is disposed on the base board and disposed between the infrared light emitter and the infrared light receiver, the other end of the connecting portion is defined as a fastening end, the fastening end of the connecting portion is fastened to a bottom of the fastening pillar.

6. The paper feeding device as claimed in claim 5, wherein a surface of the main portion of the lens facing to the infrared light emitter is an arc-shaped surface arched inward away from the infrared light emitter.

7. The paper feeding device as claimed in claim 5, wherein thicknesses of two opposite sides of the main portion of the lens are different, the two opposite sides of the main portion of the lens with the different thicknesses are a left side and a right side, the left side and the right side of the main portion are arranged opposite to each other along the direction perpendicular to the paper feeding direction, and the left side and the right side of the main portion are perpendicular to the base board, a gradual transition is formed from the thickness of one side of the main portion to the thickness of the other side of the main portion.

8. The paper feeding device as claimed in claim 5, wherein an inside of the main portion is added with a light blocking agent.

9. The paper feeding device as claimed in claim 5, wherein an outer surface of the main portion is coated with a light blocking agent.

10. The paper feeding device as claimed in claim 9, wherein the light blocking agent is titanium dioxide.

11. The paper feeding device as claimed in claim 5, wherein each of different areas of an outer surface of the main portion has one of different textures, indentations, shapes and other designs.

12. The paper feeding device as claimed in claim 1, wherein an outside of the sensing roller is sleeved with a rubber ring.

* * * * *